US006517352B2

(12) United States Patent
Smith

(10) Patent No.: US 6,517,352 B2
(45) Date of Patent: Feb. 11, 2003

(54) GOLF CLUB RHYTHMIC SWING METER

(76) Inventor: Charles D. Smith, 402 Coronado Dr., Grand Prairie, TX (US) 75052-6603

( * ) Notice: Subject to any disclaimer, the term of this patent is extended or adjusted under 35 U.S.C. 154(b) by 72 days.

(21) Appl. No.: 09/832,414

(22) Filed: Apr. 12, 2001

(65) Prior Publication Data

US 2002/0150873 A1 Oct. 17, 2002

(51) Int. Cl.[7] ..... A63B 69/36; A63B 53/06
(52) U.S. Cl. ..... 434/252; 473/224; 473/234
(58) Field of Search ..... 434/252; 473/224, 473/234

(56) References Cited

U.S. PATENT DOCUMENTS

| | | | | |
|---|---|---|---|---|
| 3,808,707 A | | 5/1974 | Fink | |
| 4,577,868 A | | 3/1986 | Kiyonga | |
| 5,027,686 A | | 7/1991 | Ishikawa | |
| 5,040,790 A | | 8/1991 | Anthes et al. | |
| 5,082,281 A | | 1/1992 | Bergofer | |
| 5,395,116 A | * | 3/1995 | Blaakman | 473/224 |
| 5,423,538 A | | 6/1995 | Stewart | |
| 5,558,519 A | | 9/1996 | Sabowitz | |
| 5,614,884 A | * | 3/1997 | Evans | 200/61.27 |
| 5,632,688 A | * | 5/1997 | Blaakman | 473/198 |
| 5,743,807 A | | 4/1998 | Bendo et al. | |
| 6,012,988 A | | 1/2000 | Burke | |
| 6,040,517 A | * | 3/2000 | Sakamoto | 340/384.71 |
| 6,179,723 B1 | * | 1/2001 | Evans | 473/219 |
| 6,259,794 B1 | * | 7/2001 | Dobbins | 215/400 |

* cited by examiner

*Primary Examiner*—John Edmund Rovnak
(74) *Attorney, Agent, or Firm*—Randal D. Homburg

(57) ABSTRACT

The invention is an adjustable audible tempo device included in the handle of a golf club or within a clip-on tube attached to the golfer or a golf bag, which may be adjusted to a repetitive rhythmic audible meter, for the development of a consistent swing speed in the swinging of a golf club or a putter.

6 Claims, 3 Drawing Sheets

GOLF CLUB RHYTHMIC SWING METER

I. BACKGROUND OF THE INVENTION

1. Field of Invention

The invention is an adjustable audible tempo device included in the handle of a golf club or within a clip-on tube attached to the golfer or a golf bag, which may be adjusted to a repetitive rhythmic audible meter, for the development of a consistent swing speed in the swinging of a golf club or a putter.

2. Description of Prior Art

The following United States patents were discovered and are disclosed within this application for utility patent. All relate to golf club swing meters and audible metronomes relative to the development of a consistent golf swing or to alert a golfer of a swing error.

In U.S. Pat. No. 6,012,988 to Burke, a device is disclosed which is contained within the upper portion of a golf shaft, the device indicating an over-swing by a golfer, apparently using an inertial activated electrical circuit mechanism. An electronic metronome with a timing indicator adjustable in length of time and the spacing of rhythmic signal is disclosed in U.S. Pat. No. 5,027,686 to Ishikawa.

Five U.S. Patents disclose audible sound producing metronomes either worn by the golfer having an earphone or placed near the golfer producing an audible signal, including U.S. Pat. No. 5,743,807 to Bendo, U.S. Pat. No. 5,558,519 to Sabowitz, U.S. Pat. No. 5,082,281 to Berghofer and U.S. Pat. No. 5,040,790 to Anthes and U.S. Pat. No. 3,808,707 to Fink. In U.S. Pat. No. 4,577,868 to Kiyonaga, two plates stood on by a golfer detect the golfer's weight during the swing and also produce three audible prompts from a chime during the swing to signal the timing of the stroke and indicating the weight shift of the golfer during the swing, also producing a visible lighting pattern to indicate the weight shift sequence. U.S. Pat. No. 5,423,538 to Stewart, discloses some sort of "sensible" signal, apparently indicating the linear length of the backstroke and swing stroke, primarily with a putter, using a tube with a non-descriptive microswitch to produce this "sensible" signal. This applicant is not quite sure how this invention works, but is rather confident it is dissimilar enough not to pose a novelty problem with the current invention.

The current invention is distinguished in that it is applied within the upper portion of the golf club shaft underneath the golf grip, incorporated within the golf club itself the audible rhythmic signal emitted from the end of the golf grip detected by the golfer during their swing, or it may be encased and hung on a nearby golf club bag. One embodiment of this invention may be installed underneath the golf grip, primarily installed in a utility practice club not used during a regular round of golf, the device having a tubular size and shape to fit within the upper end of the golf shaft having a pin to adjust the golf tempo speed.

II. SUMMARY OF THE INVENTION

The primary objective of the invention is to provide an adjustable audible rhythmic golf aid installed within the golf club for practicing swing timing. The invention is an electronic device that allows the weekend golfer to practice a consistent and repeatable tempo. It can be use on a practice range and on the course, emitting an audible sound that allows the golfer to practice their swing, synchronized to its audible pulse to achieve a more smooth consistent swing tempo.

Unlike a metronome, used in music and in other sports training devices, the invention pulse rate is centered at 63 pulses per minute, which is an optimum tempo for the golf swing. The pulse rate is adjusted to increase or decrease such rate allowing it to adjust to the individual golfer.

The invention is provided in an electronically configured component assembly for placement within a golf shaft and also placement within a clip-on tube, the clip-on tube being attached to a golf bag, belt loop or within a pocket. When placed in the golf shaft, under the grip, the device is turned on by insertion of a conductive pin and adjustment is made by turning the pin, accessed through a hole in the top of the grip. Removal of the conductive pin turns the device off. Regarding the clip-on tube, it is activated similar to the activation of a ball point pin, using a simple electronic click switch.

In the event the tempo rate is too slow, golfers will find that loss of balance and improper shift occurs during the backswing, often causing a chop where the club head is grounded before striking the ball causing a resultant hook. With a too fast tempo, the golfer will notice a bend in the elbow and inability to return the club head to the correct point of impact without rushing the downswing, placing the hands in front of the ball resulting in a slice. Once the correct tempo is established, the backswing and down swing are in sync with the body and the hands, resulting in proper impact and contact with the ball. By installing the device in a golf club, the golfer is able to have the club with the golfer at all times, whether at the driving range, the practice green or on the golf course. The device may be used in all clubs, including woods, irons, wedges and putters.

III. DESCRIPTION OF THE DRAWINGS

The following drawings are submitted with this utility patent application.

IV. DESCRIPTION OF THE PREFERRED EMBODIMENT

Figure 1:
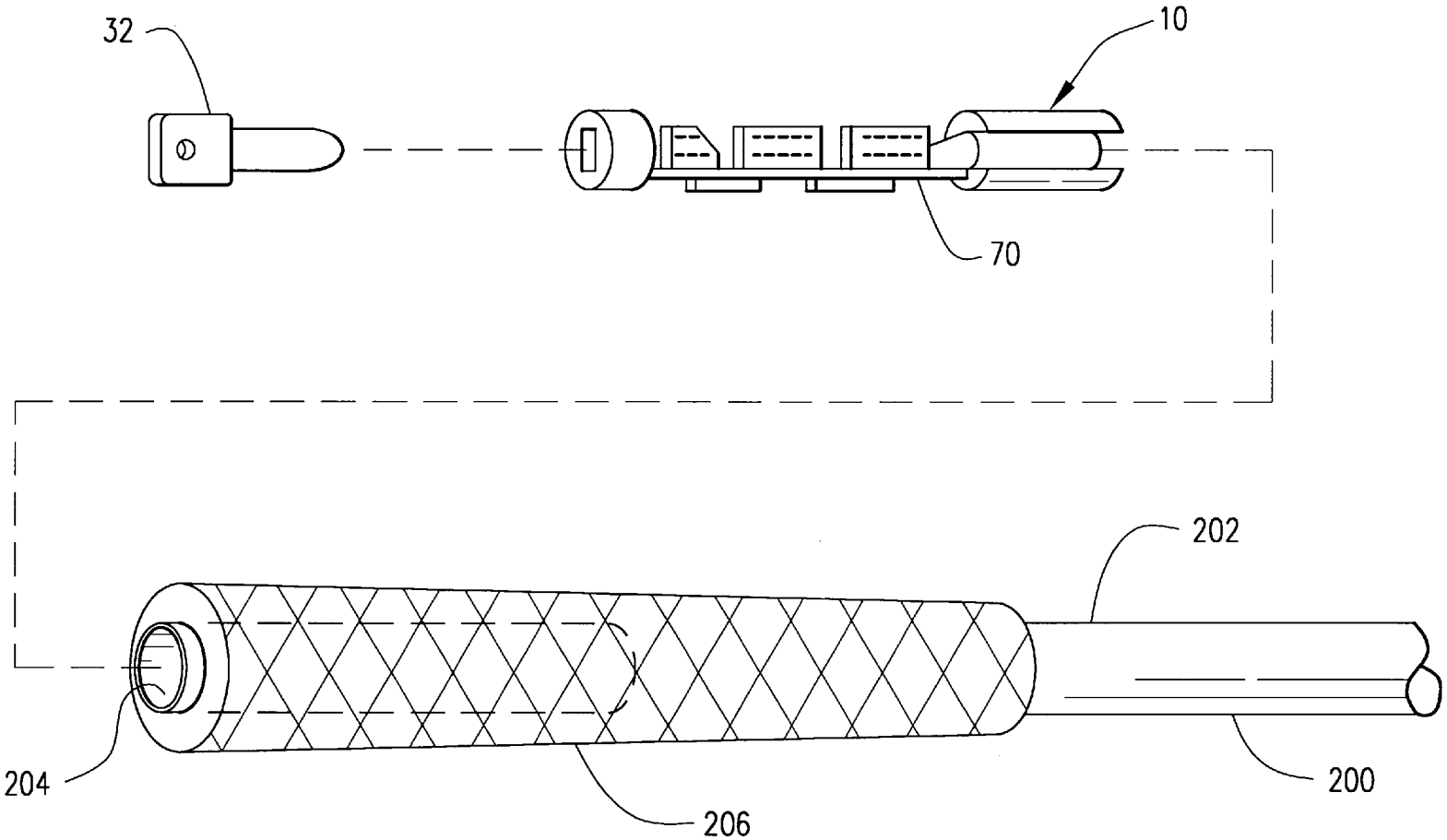
FIG. 1 is a perspective view of the device prior to installation in a golf shaft.
Figure 2:
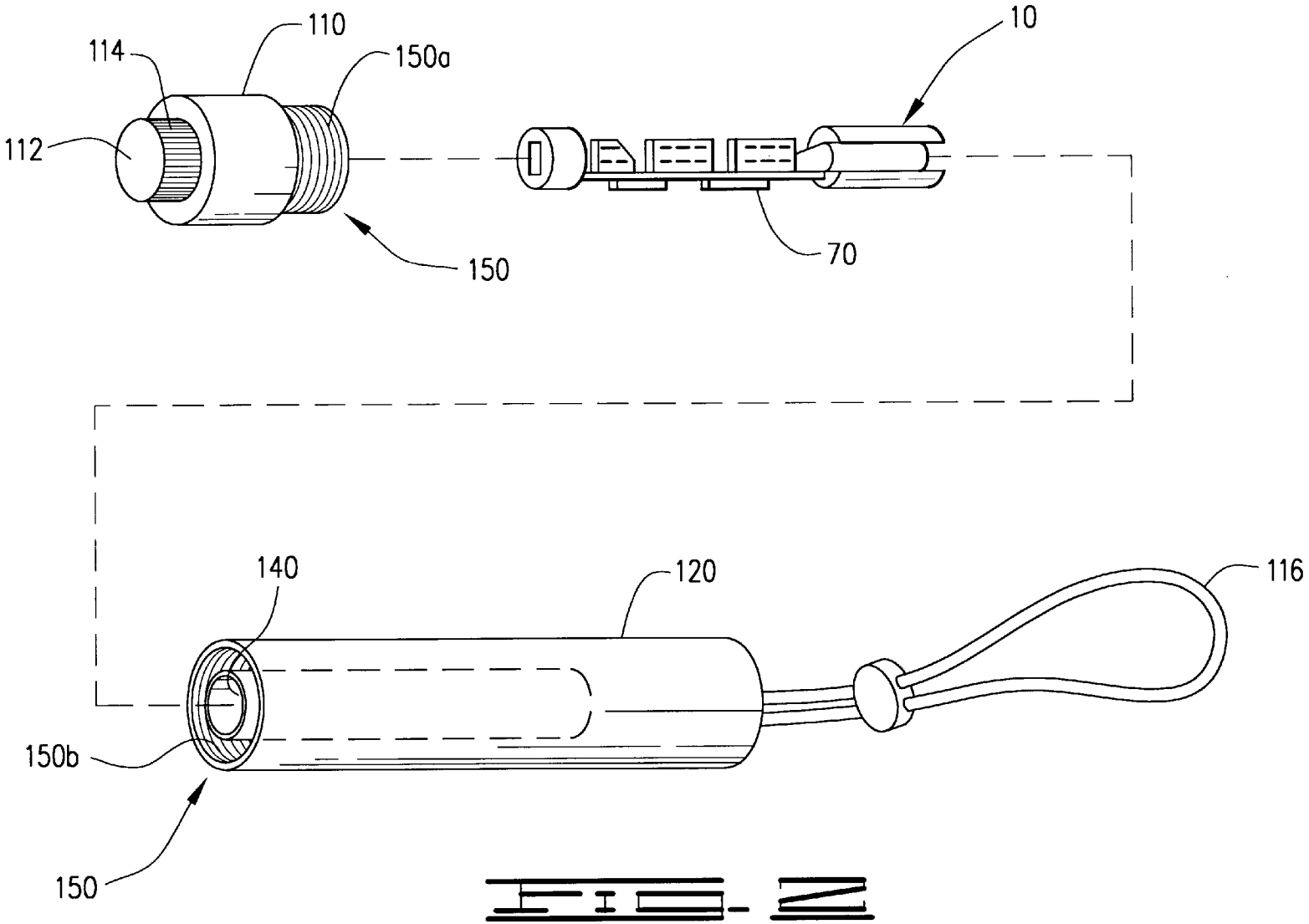
FIG. 2 is a cross section of the device within the clip-on tube.
Figure 3:
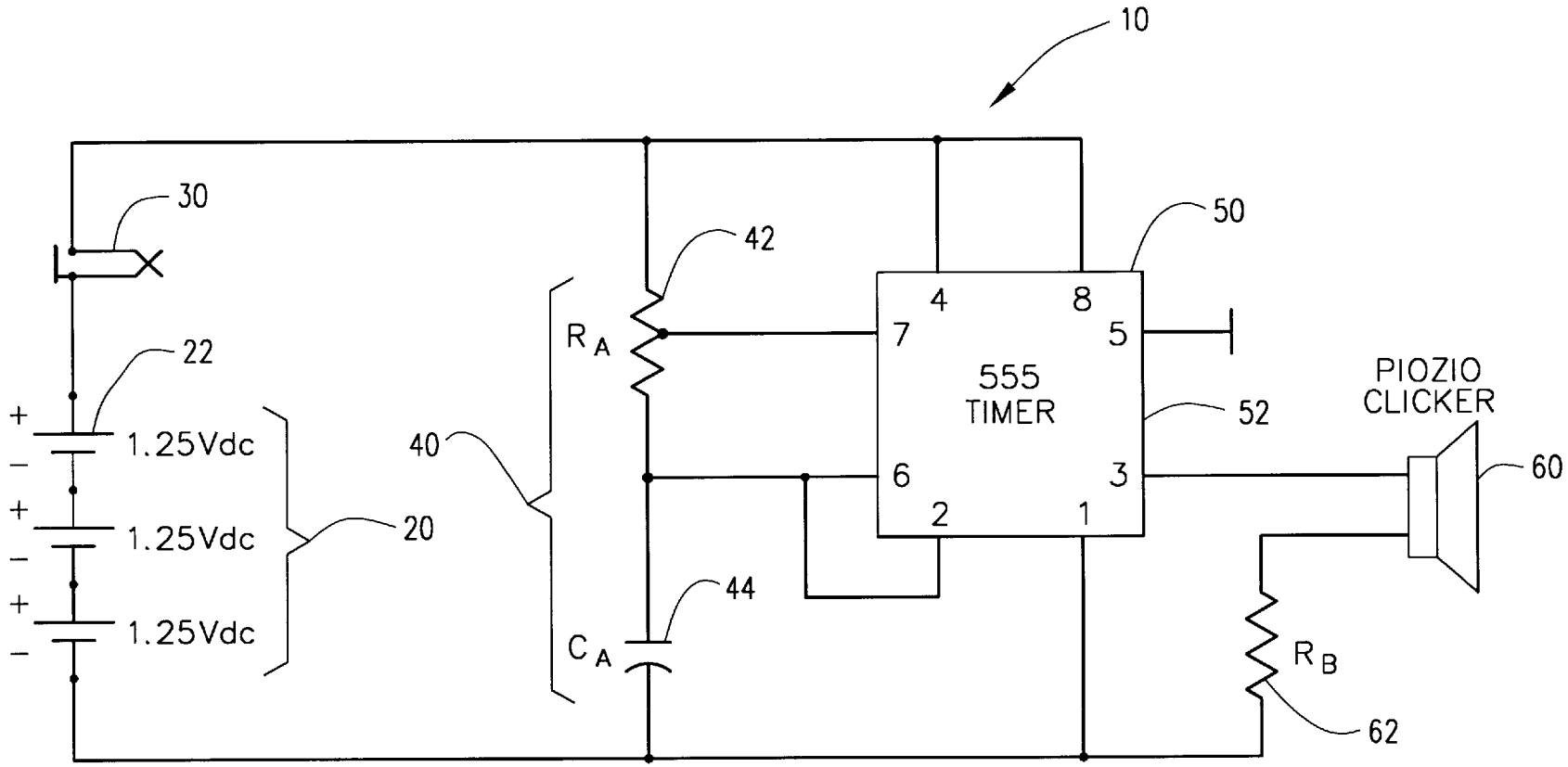
FIG. 3 is basic electrical schematic of the invention.

The invention, as shown in FIGS. 1–3 of the drawings, is an electronic device 10 for supplying an adjustable audible pulse for golfers to encourage and develop a rhythm in their golf swing, the device 10 placed either within an interior 204 in an upper end 202 of a golf shaft 200 on a golf club beneath a golf grip 206 on the upper end 202 of the golf shaft 200 or within a clip-on tube 100 to be clipped onto the golfer or nearby golf equipment. This device 10 essentially comprises a compact battery power supply 20, a power switch 30, and tempo adjustment means 40, a timer microchip 50, a piezoelectric clicker 60, and an integrated circuit board 70.

As indicated in FIG. 3 of the drawings, the power supply 30 is preferably three 1.25 volt watch batteries 32 connected to the integrated circuit board 70. This power supply 30 activates the device 10 when the power switch 30 is closed. Most preferably this power switch 30 may be closed by the insertion of a conductive pin 32 which will complete the electrical circuitry.

The integrated circuit board 70 contains the timer microchip 50, which is most preferably an eight pin 555 timer chip 52. This timer microchip 50 is further connected, via a first resistor 62, to the piezoelectric clicker 60 for the generation of the audible sound. The tempo adjustment means 40 is preferably provided by the connection of the timer microchip 50 to a second resistor 42 and a fixed electrolytic capacitor 44 allowing for the audible pulse of the device 10 to be adjusted more or less from a basic set 63 clicks per minute tempo. Most preferably, this alteration may be performed by insertion of the conductive pin 32 into the tempo adjustment means 40, rotating the conductive pin 32 until a desired tempo is reached. Most preferably, the conductive pin 32 closes the electrical circuitry activating the device 10 at the same time the tempo adjustment means 40 is engaged.

In a first embodiment of the invention, as shown in FIG. 2 of the drawings, the device 10 is of an overall size to be inserted within the upper end 202 of the golf shaft 200 of a golf club. This installation is performed by removal of the golf grip 206 from the upper end 202 of the golf shaft 200, situating the device 10 within the interior 204 of the golf shaft 200 and immovably affixing the device 10 within the golf shaft 200 wherein the power switch 30 and the tempo adjustment means 40 are configured outward from the upper end 202 of the golf shaft 200. After replacing the golf grip 206, the power switch 30 should be exposed through a hole in the golf grip 206, allowing access to the power switch 30 and the tempo adjustment means 40.

In a second embodiment, as shown in FIG. 3 of the drawings, the device 10 is placed within the clip-on tube 100, such clip-on tube 100 comprising a first component 110 and a second detachable component 120 connected by an attachment means 150. In a preferred embodiment, the attachment means 150 may be a threaded engagement 150*a*, 150*b* between the first component 110 and the second detachable component 120, attaching the first component 110 to the second detachable component 120, defining an internal cavity 140 conforming in size and shape to the interior 204 of the upper end 202 of the golf shaft 200. The device 10 is placed within the internal cavity 140.

The first component 110 has a click switch 112 which activates the power switch 30 on the contained device 10. Also on the first component 110 is an adjustment mechanism 114 to engage the tempo adjustment means 40 on the device 10 to a selected rhythmic tempo. In a preferred embodiment, the click switch 112 and the adjustment mechanism 114 may be the same component, having the depression of the click switch 112 activate the power switch 30 and the rotation of the click switch 112 adjusting the tempo adjustment means 40. A clip-on means 116 is contained on the clip-on tube 100 to attach the clip-on tube 100 to the golfer or to a golf accessory.

While the invention has been particularly shown and described with reference to a preferred embodiment thereof, it will be understood by those skilled in the art that changes in form and detail may be made therein without departing from the spirit and scope of the invention.

What is claimed is:

1. An electronic device for supplying an adjustable audible pulse for golfers to encourage and develop a rhythm in their golf swing, the device placed within an upper end of a golf shaft on a golf club beneath a golf grip on the upper end of the golf shaft, such device comprising, at least:

a. a compact battery power supply;

b. a power switch;

c. an tempo adjustment means;

d. a timer microchip;

e. a Piezo clicker; and f. an integrated circuit board.

2. The device, as disclosed in claim 1, wherein the power supply is three 1.25 volt watch batteries.

3. The device as disclosed in claim 1, wherein the integrated circuit board contains the timer microchip which is an eight pin 555 timer chip which is provided with a basic set rate of 63 clicks per minute, adjustable more or less by altering the tempo adjustment means, such tempo adjustment means including a resistor and a fixed electrolytic capacitor.

4. An electronic device for supplying an adjustable audible pulse for golfers to encourage and develop a rhythm in their golf swing, the device comprising, a compact battery power supply, a power switch, an tempo adjustment means, a timer microchip, a Piezo clicker, and an integrated circuit board, such device placed within a clip-on tube, the clip-on tube comprising an attachment means, a first component having an external thread, a second detachable component having an internal thread engaging the external thread of the first component, the first component and the second detachable component forming a cylindrical tube having an internal cavity within which the electronic device is held, the first component further providing a click switch activating the power switch and an adjustment mechanism to adjust the tempo adjustment means.

5. The device, as disclosed in claim 4, wherein the power supply is three 1.25 volt watch batteries.

6. The device as disclosed in claim 4, wherein the integrated circuit board contains the timer microchip which is an eight pin 555 timer chip which is provided with a basic set rate of 63 clicks per minute, adjustable more or less by altering the tempo adjustment means, such tempo adjustment means including a resistor and a fixed electrolytic capacitor.

* * * * *